United States Patent [19]

Johnson

[11] 4,350,430

[45] Sep. 21, 1982

[54] MOTOR DRIVE DESIGN

[75] Inventor: Ronald M. Johnson, Pasadena, Calif.

[73] Assignee: Dev Tec Resources, Inc., Pasadena, Calif.

[21] Appl. No.: 225,638

[22] Filed: Jan. 16, 1981

[51] Int. Cl.[3] ..... G03D 3/04

[52] U.S. Cl. ..... 354/330; 366/208; 366/233

[58] Field of Search ..... 354/312, 329, 330; 366/208, 213, 233, 218

[56] References Cited

U.S. PATENT DOCUMENTS

| | | | |
|---|---|---|---|
| 2,947,236 | 8/1960 | Siegel | 354/330 |
| 3,981,488 | 9/1976 | Ratowsky | 354/329 |
| 4,227,794 | 10/1980 | Tabin | 354/330 |
| 4,269,501 | 5/1981 | Griffith et al. | 354/330 |

*Primary Examiner*—L. T. Hix
*Assistant Examiner*—Alan Mathews
*Attorney, Agent, or Firm*—Joseph E. Mueth

[57] ABSTRACT

A photograph materials processing unit having:
a motor drive unit comprising,
a base member which has an upper surface, and
a drive wheel extending from the upper surface which is in operative relationship to a drive motor, the drive motor also being part of the base.

The upper surface of the base member also carries a pair of spaced-apart undriven wheels which are rotatable in planes parallel to the plane of rotation of said drive wheel.

The motor drive unit is adapted to carry a cylindrical drum for receiving photographic materials including film and liquid processing chemicals. The drum is carried in 3-point contact on the upper surfaces of the wheels whereby when the drive motor is turned on, the drum rotates on the wheels without substantial longitudinal movement of the drum with respect to the motor drive unit so long as the longitudinal center line of the drum is parallel to the axes of rotation of the wheels.

4 Claims, 4 Drawing Figures

MOTOR DRIVE DESIGN

BACKGROUND OF THE DISCLOSURE

The photoprocessing of photograph film including prints typically involve sequential contacting with various chemicals such as developers, fixers and the like. These photographic materials are well-known in the art, and require no detailed discussion or description here. The contacting is commonly carried out in a processing drum which has to be continuously turned or rotated about its longitudinal axis in order that the chemicals be uniformly distributed and contacted with the film. Various motor drives have been proposed for the rotation of the processing drum. Known motor drives have a tendency to walk the tube off one end or other unless carefully leveled and then of course will still have the same problem eventually. The present invention, by virtue of a three wheel operation, always guarantees that the tube finds a center balance. It will even climb up hill to center in the event of an unlevel base. The three wheel system allows an unbalanced drum to tip. The tip also causes the drum to become unparallel with the wheel axis on a horizontal plane. This lack of parallelism causes the drum to be driven toward center until it becomes balanced. The major feature of this invention is the self-centering capability.

Thus, the present invention solves a significant problem in this art, and it is to be expected that the present invention will be widely adopted by those skilled in the art.

SUMMARY OF THE INVENTION

Briefly, the present invention comprehends a motor drive unit comprising:

a base member, said base member having an upper surface, a drive wheel extending from said upper surface which is in operative relationship to a drive motor, a drive motor, said upper surface of said base member also carrying a pair of spaced apart undriven wheels which are rotatable in planes parallel to the plane of rotation of said drive wheel.

This invention further includes a photograph materials processing unit having:

(1) a motor drive unit comprising, a base member, said base member having an upper surface, a drive wheel extending from said upper surface which is in operative relationship to a drive motor, said upper surface of said base member also carrying a pair of spaced apart undriven wheels which are rotatable in planes parallel to the plane of rotation of said drive wheel, and (2) a cylindrical drum adapted to receive photographic materials including film and liquid processing chemicals, said drum being carried in 3-point contact on the upper surfaces of said wheels whereby when the drive motor is turned on, the drum rotates on the wheels without substantial longitudinal movement of said drum with respect to said motor drive unit so long as the longitudinal center line of said drum is parallel to the axes of rotation of said wheels.

It is an object of this invention to provide a novel motor drive unit.

It is a major object of this invention to provide a novel photograph processing unit.

It is a major object and advantage of this unit to provide a novel photographic processing unit wherein the unit is selfcentering and its operation is not dependent upon location of a perfectly level surface.

These and other objects and advantages of my invention will be apparent from the detailed description which follows, particularly when considered in conjunction with the accompanying drawings.

DESCRIPTION OF THE PREFERRED EMBODIMENTS

Turning to the drawings.

Figure 1:
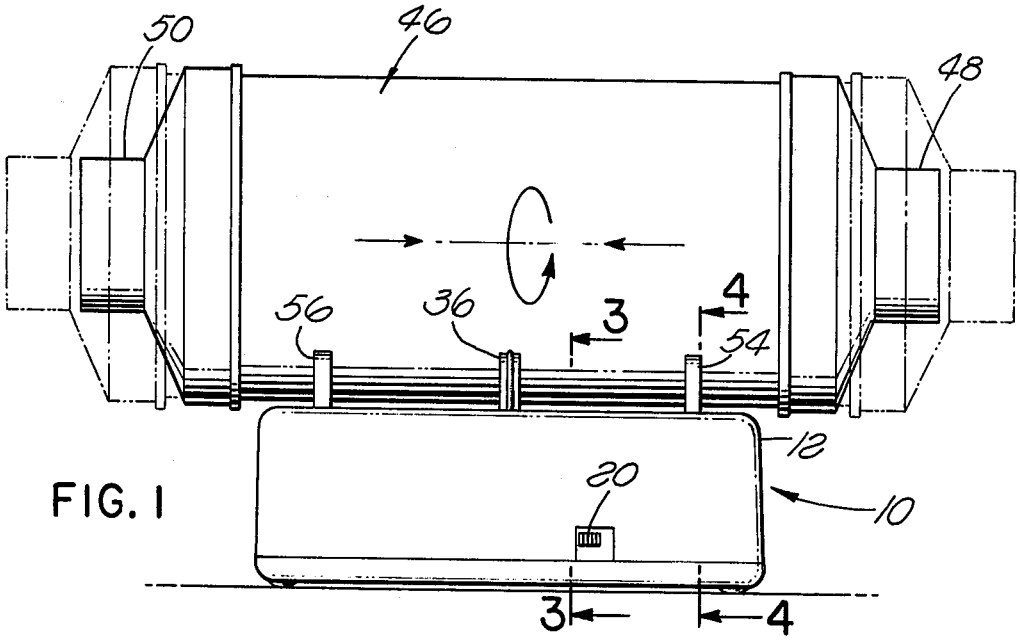
FIG. 1 is a side view of a preferred embodiment of the motor drive unit and processing drum of this invention.
Figure 2:
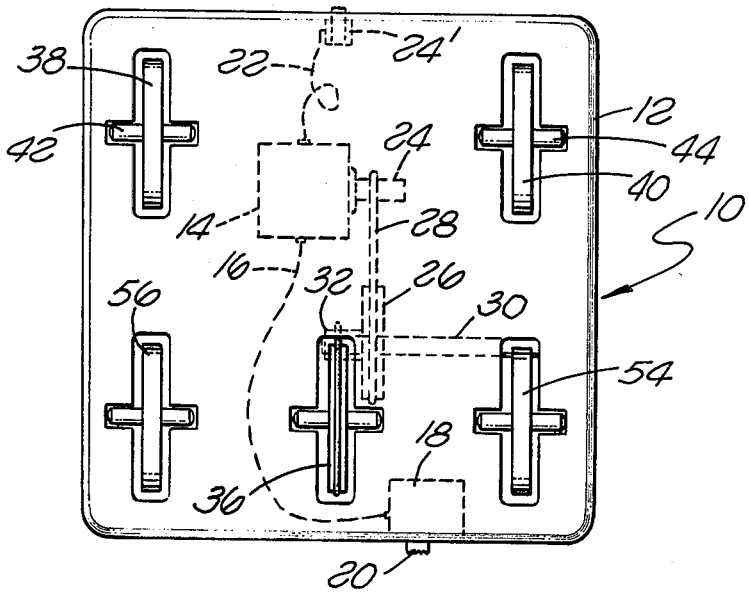
FIG. 2 is a top plane view of the preferred drive unit and processing drum.
Figure 3:
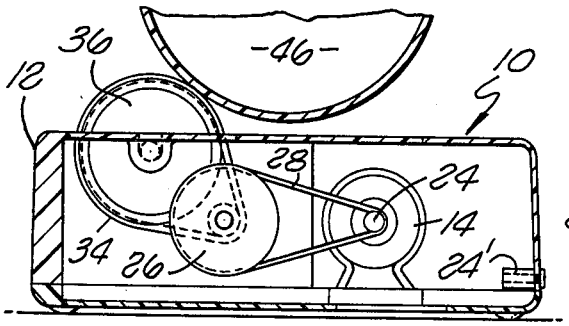
FIG. 3 is a sectional view taken along the line 3—3 in FIG. 1.
Figure 4:
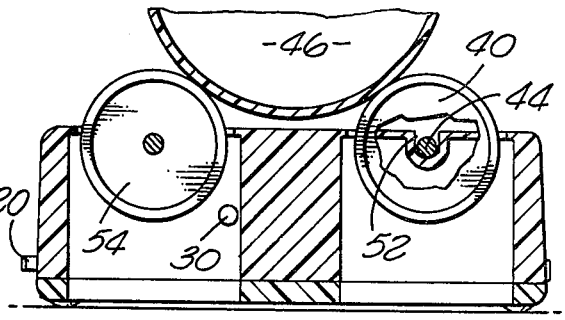
FIG. 4 is a sectional view taken along the line 4—4 in FIG. 1.

Considering the drawings in greater detail, the motor drive unit, generally indicated as 10, has a housing 12 which encloses a 12 volt drive motor 14 which is electrically connected via line 16 to an on-off switch 18 operated by a thumb slidable element 20. The power for motor 14 is provided via line 22 which leads to jack 24' which in turn is adapted to be connected to an ordinary plug and outlet (not shown). The current in line 22 is preferably 12 volts DC. The motor 14 has an output shaft 24. Intermediate pulley 26 is driven by belt 28 and is rotatable along with shaft 30. The free end 32 of rotatable shaft 30 drives a second belt 34 which also wraps around and drives the drive wheel 36.

The other two essential elements of the motor drive unit are undriven wheels 38 and 40, fixedly connected to shafts 42 and 44 respectively.

The photographic processing drum 46 is, per se, of conventional cylindrical configuration as shown and has removable caps 48 and 50 at each of its ends. The caps may be provided with ports or openings for the addition and removal of photochemical processing solutions and may further be provided internally with light baffles, as is known in the art. The shafts 42 and 44 are received and rotate within slots or recesses as shown at 52.

The upper surfaces of drive wheel 36 and undriven wheels 38 and 40 provide a three point contact support for drum 46.

In operation, with the power to drive motor 14 "on", the drive wheel 36 turns which by virtue of its frictional engagement with the exterior of drum 46, rotates the drum and the drum, in turn, frictionally engages wheels 38 and 40, turning them.

I have found that the three wheel system allows drum 46 to tip when unbalanced due, for example, to base 10 not being level. The tipping causes the longitudinal center line of drum 46 to become non-parallel to the axes of rotation of the three wheels which are always parallel to each other. The lack of parallelism between the center line of the drum 46 and the axes of rotation of the three wheels causes drum 46 to be driven longitudinally, that is, across the base 10 until the drum 46 becomes balanced in which case its longitudinal axis becomes parallel to the other axes. The contained photochemical liquids are thus maintained in uniform distribution with drum 46 and there is no pooling or accumulation at one end of the drum as has been the problem in the prior art.

The auxilliary undriven wheels 54 and 56 on either side of the driving wheel 36 are only desirable when the drum 46 is rather long with respect to the distance between the three wheels, or when the drum is heavily loaded with chemical processing fluid or water, in which case wheels 54 and 56 serve to prevent overaction and excessively tipping or unbalance.

Having fully described the invention, it is intended that it be limited only by the lawful scope of the appended claims.

I claim:

1. A motor drive unit comprising:

a base member, said base member having an upper surface, a drive wheel extending from said upper surface which is in operative relationship to a drive motor, a drive motor, said upper surface of said base member also carrying a pair of spaced apart undriven wheels which are rotatable in planes parallel to the plane of rotation of said drive wheel, said base member being adapted to receive a cylindrical processing drum for containing photograph film and liquid processing chemicals for the film by 3-point contact on the surfaces of said wheels whereby said drum is free to move longitudinally with respect to said base until said drum has leveled itself to uniformly distribute liquid processing chemicals over the length of the interior of said drum.

2. The unit of claim 1 wherein undriven wheels are provided on either side of the driving wheel to prevent excessive tipping or unbalance of the drum.

3. A photograph materials processing unit having:

(1) a motor drive unit comprising, a base member, said base member having an upper surface, a drive wheel extending from said upper surface which is in operative relationship to a drive motor, said upper surface of said base member also carrying a pair of spaced apart undriven wheels which are rotatable in planes parallel to the plane of rotation of said drive wheel, and (2) a cylindrical drum adapted to receive photographic materials including film and liquid processing chemicals, said drum being carried in 3-point contact on the upper surfaces of said wheels whereby when the drive motor is turned on, the drum rotates on the wheels and is free for longitudinal movement with respect to said motor drive unit only until the longitudinal center line of said drum is parallel to the axes of rotation of said wheels signifying that the drum is level and the contained liquid processing chemicals are uniformly distributed over the interior of said film.

4. The unit of claim 3 wherein undriven wheels are provided on either side of the driving wheel to prevent excessive tipping or unbalance of the drum.

* * * * *